US008636504B2

(12) United States Patent
Krieger et al.

(10) Patent No.: US 8,636,504 B2
(45) Date of Patent: Jan. 28, 2014

(54) FUEL NOZZLE HAVING SWIRL DUCT AND METHOD FOR PRODUCING A FUEL NOZZLE

(75) Inventors: Tobias Krieger, Duisburg (DE); Elmar Pfeiffer, Heinsberg (DE)

(73) Assignee: Siemens Aktiengesellschaft, München (DE)

( * ) Notice: Subject to any disclaimer, the term of this patent is extended or adjusted under 35 U.S.C. 154(b) by 632 days.

(21) Appl. No.: 12/864,928

(22) PCT Filed: Nov. 7, 2008

(86) PCT No.: PCT/EP2008/065135

§ 371 (c)(1),
(2), (4) Date: Jul. 28, 2010

(87) PCT Pub. No.: WO2009/095100

PCT Pub. Date: Aug. 6, 2009

(65) Prior Publication Data

US 2010/0330521 A1 Dec. 30, 2010

(30) Foreign Application Priority Data

Jan. 29, 2008 (EP) ..... 08001641

(51) Int. Cl.
*F23D 11/38* (2006.01)

(52) U.S. Cl.
USPC ..... 431/354; 431/171; 431/350; 29/890.143; 239/406

(58) Field of Classification Search
USPC ..... 431/354, 171, 350, 351; 29/889.22, 29/889, 22, 890.143; 239/406
See application file for complete search history.

(56) References Cited

U.S. PATENT DOCUMENTS

| | | | | |
|---|---|---|---|---|
| 1,713,357 | A * | 5/1929 | St Clair | 239/464 |
| 3,337,135 | A * | 8/1967 | Blakely et al. | 239/589.1 |
| 4,133,485 | A * | 1/1979 | Bouvin | 239/399 |
| 4,255,124 | A * | 3/1981 | Baranowski, Jr. | 431/353 |
| 6,082,111 | A | 7/2000 | Stokes | |
| 6,409,502 | B2 * | 6/2002 | Bury | 431/350 |
| 6,901,760 | B2 * | 6/2005 | Dittmann et al. | 60/773 |
| 6,918,256 | B2 * | 7/2005 | Gutmark et al. | 60/737 |
| 6,931,854 | B2 * | 8/2005 | Saitoh et al. | 60/737 |
| 7,104,464 | B2 * | 9/2006 | Kobayashi et al. | 239/5 |
| 7,454,914 | B2 * | 11/2008 | Prociw | 60/772 |
| 7,509,808 | B2 * | 3/2009 | Storey et al. | 60/740 |
| 7,520,745 | B2 * | 4/2009 | Oomens et al. | 431/354 |
| 7,762,070 | B2 * | 7/2010 | Dawson et al. | 60/740 |
| 7,992,808 | B2 * | 8/2011 | Micheli | 239/487 |

(Continued)

FOREIGN PATENT DOCUMENTS

| | | | |
|---|---|---|---|
| DE | 4438495 | A1 | 5/1995 |
| EP | 1936276 | * | 6/2008 |

(Continued)

*Primary Examiner* — Alfred Basichas

(57) ABSTRACT

A method for producing a fuel nozzle is provided. In the method a swirl duct is mounted in an outer jacket surface of a pin and/or in an inner surface of a sleeve and the pin is attached in the sleeve so that the outer jacket surface of the pin is connected to the inner surface wherein the pin is disposed in the sleeve. The outer jacket surface of the pin and/or the inner surface of the sleeve includes at least one-swirl duct. A fuel nozzle and a burner are also further disclosed wherein the burner includes the fuel nozzle.

12 Claims, 5 Drawing Sheets

(56) References Cited

U.S. PATENT DOCUMENTS

| | | | | |
|---|---|---|---|---|
| 8,142,186 | B2 * | 3/2012 | Nilsson et al. | 431/246 |
| 8,220,269 | B2 * | 7/2012 | Poyyapakkam | 60/737 |
| 8,220,271 | B2 * | 7/2012 | Poyyapakkam et al. | 60/740 |
| 2002/0172905 | A1 * | 11/2002 | Ruck et al. | 431/354 |
| 2009/0293482 | A1 * | 12/2009 | Davis et al. | 60/737 |
| 2010/0071374 | A1 * | 3/2010 | Fox et al. | 60/734 |
| 2010/0170267 | A1 * | 7/2010 | Boettcher et al. | 60/796 |
| 2011/0113784 | A1 * | 5/2011 | Headland et al. | 60/737 |

FOREIGN PATENT DOCUMENTS

| | | | |
|---|---|---|---|
| GB | 1175793 | A | 12/1969 |
| JP | 2001280641 | A | 10/2001 |
| JP | 2005195284 | A | 7/2005 |
| JP | 2008170148 | A | 7/2008 |
| WO | WO 2005061964 | A1 | 7/2005 |

* cited by examiner

FUEL NOZZLE HAVING SWIRL DUCT AND METHOD FOR PRODUCING A FUEL NOZZLE

CROSS REFERENCE TO RELATED APPLICATIONS

This application is the US National Stage of International Application No. PCT/EP2008/065135, filed Nov. 7, 2008 and claims the benefit thereof. The International Application claims the benefits of European Patent Office application No. 08001641.3 EP filed Jan. 29, 2008. All of the applications are incorporated by reference herein in their entirety.

FIELD OF INVENTION

The present invention relates to a fuel nozzle with a swirl duct and to a method for manufacturing a fuel nozzle. The invention further relates to a burner and to a gas turbine.

BACKGROUND OF INVENTION

With combustion machines, especially such as are operated with two different fuels, oil as a fuel is typically injected via swirl ducts in which the oil is mixed with air. For improved mixing of oil and air a swirling movement is imparted to the oil within the nozzles used for injection. This swirl generation has previously been achieved by these nozzles consisting of number of small plates having small holes at coordinates which deviate slightly from one another. By soldering together the individual plates a spiral is produced which is used for swirling the fuel. However such nozzles have a complicated layout in construction terms since the holes must be placed exactly.

SUMMARY OF INVENTION

It is therefore a first object of the present invention to provide an alternate, advantageous method for manufacturing a fuel nozzle. A second object of the present invention consists of providing an alternate advantageous fuel nozzle. A third object of the present invention consists of disclosing an advantageous burner. A fourth object of the invention is to provide an advantageous gas turbine.

The first object is achieved by a method for manufacturing a fuel nozzle as claimed in the claims. The second object is achieved by a fuel nozzle as claimed in the claims. The third object is achieved by a burner as claimed in the claims. The fourth object is achieved by gas turbine as claimed in the claims. The independent claims contain further advantageous embodiments of the invention.

Within the framework of the inventive method for manufacturing a fuel nozzle at least one swirl duct is mounted in an outer jacket surface of a pin and/or in an inner surface of a sleeve. Subsequently the pin is attached in the sleeve so that the outer jacket surface of the pin is connected to the inner surface of the sleeve without completely sealing the duct when this is done. With the aid of the inventive method any swirl-inducing contours can be created flexibly and at low-cost.

The swirl duct can typically be milled, turned, punched, eroded, sintered or profile-extruded into the outer jacket surface of the pin and/or into the inner surface of the sleeve. The pin and/or the sleeve can also be cast, with the swirl duct being defined by the mold shape. Furthermore the pin can be soldered into the sleeve or driven in.

Basically the swirl-inducing contour or the swirl duct respectively can be shaped and designed in any way. Advantageously the swirl duct can be made in the form of a spiral into the outer jacket surface of the pin and/or into the inner surface of the sleeve. It is also advantageous for at least two swirl ducts, especially three swirl ducts to be made. For example one swirl duct can also be made in the outer jacket surface of the pin and a further swirl duct can be made in the inner surface of the sleeve. These two swirl ducts can especially be arranged offset in relation to one another.

Both the outer jacket surface of the pin and also the inner surface of the sleeve can basically be formed in any given way. They can for example be cylindrical, eccentric or spherical in shape. Changing these parameters as well as the number of swirl ducts enables how the fuel leaves the nozzle to be adjusted in a suitable manner.

The inventive fuel nozzle comprises a pin with an outer jacket surface and a sleeve with an inner surface. The pin is arranged within the sleeve. The outer jacket surface of the pin and/or the inner surface of the sleeve have at least one swirl duct. The inventive fuel nozzle allows a swirling motion to be imparted to the fuel by a nozzle with a simple design in construction terms. This makes possible improved mixing of the fuel with the air.

The swirl duct can be embodied in the shape of a spiral for example. The outer jacket surface of the pin and/or the inner surface of the sleeve can especially be embodied cylindrical, spherical or eccentric. This makes for great flexibility in the selection of the swirl-inducing geometry. The fuel nozzle can also comprise at least two swirl ducts, for example three swirl ducts.

In addition the pin can have a cover surface, the sleeve can have an exit opening and the pin can be arranged in the sleeve so that the cover surface is arranged in relation to the exit opening set back towards the inside of the sleeve. In this way a swirl chamber is formed inside the sleeve between the cover surface and the exit opening. Within the swirl chamber the fuel can mix well with the air as a result of the swirling motion of the fuel.

Instead of the cover surface set back in relation to the exit opening it is also possible, for fawning a swirl chamber, for the cover surface and the exit opening to lie in one plane and therefore to be flush, with the fuel nozzle then being set back itself in relation to the outer jacket surface of the attachment. In other words: The fuel nozzle with a cover surface and exit opening lying in one plane is sunk into the attachment deep enough for the exit opening to be arranged closer to the center axis of the burner than the surface of the attachment otherwise present there. In this case the swirl chamber is delimited by the attachment—in relation to the center axis of the fuel nozzle. The swirl chamber then lies outside, i.e. upstream from the nozzle.

Naturally it is also possible for both the cover surface of the pin to be set back in relation to the exit surface of the sleeve and for the exit surface of the sleeve to be set back in relation to the cover surface of the attachment. This produces a stepped swirl duct.

In a further advantageous embodiment the surface of the exit opening is smaller than the cover surface of the pin. This leads, with a cover surface set back in relation to the exit opening, to a swirl chamber within the nozzle the flow cross-section surface of which reduces in the direction of flow—i.e. from the cover surface towards the exit opening—along the central axis of the fuel nozzle. Reducing the cross-sectional surface of the swirl chamber enables an increase in the flow speed of the fuel/air mixture to be achieved which promotes mixing. The manner of the narrowing or diminution of the cross-sectional surface of the swirl chamber can be linear, convex-concave curved or any other type in such cases. Preferably the narrowing occurs however symmetrically to the center axis of the fuel nozzle.

The inventive fuel nozzle can basically be used for any fuel. It can especially be embodied as an oil nozzle.

The inventive burner comprises an inventive fuel nozzle with the features described above. The inventive burner has the same advantages as the inventive fuel nozzle.

The inventive burner can additionally comprise an attachment, with the fuel nozzle being arranged in the attachment. The attachment can be embodied pointed for example. Furthermore the attachment can include a center axis. In addition the fuel nozzle can also include a center axis and be arranged in the attachment so that the center axis of the fuel nozzle is at an angle of between 45° and 90° to the center axis of the attachment. This enables the direction in which the fuel is injected into a combustion chamber to be influenced in a flexible manner.

The inventive gas turbine comprises an inventive burner and has the same advantages as the inventive burner previously described.

A gas turbine typically comprises a compressor, one or more burners, a combustion chamber and a turbine. During operation of the gas turbine air is compressed by the compressor. The compressed air provided at the turbine-side end of the compressor is supplied to the burners and mixed there with a fuel. The mixture is then burnt in the combustion chamber to form a working medium. From there the working medium flows to the turbine and drives the latter.

Overall the inventive fuel nozzle can be manufactured quickly and at low cost, typically with the aid of the inventive method. It is characterized by a high flexibility in the selection of the swirl-inducing geometry and is flexible in its use.

BRIEF DESCRIPTION OF THE DRAWINGS

Further advantages, features and characteristics of the present invention are explained in greater detail below on the basis of exemplary embodiments which refer to the enclosed figures. The features of the exemplary embodiments can be of advantage in such cases individually or in combination with each other.

DETAILED DESCRIPTION OF INVENTION

A first exemplary embodiment of the present invention will be explained in greater detail below with reference to FIGS. 1 through 7.

Figure 1:
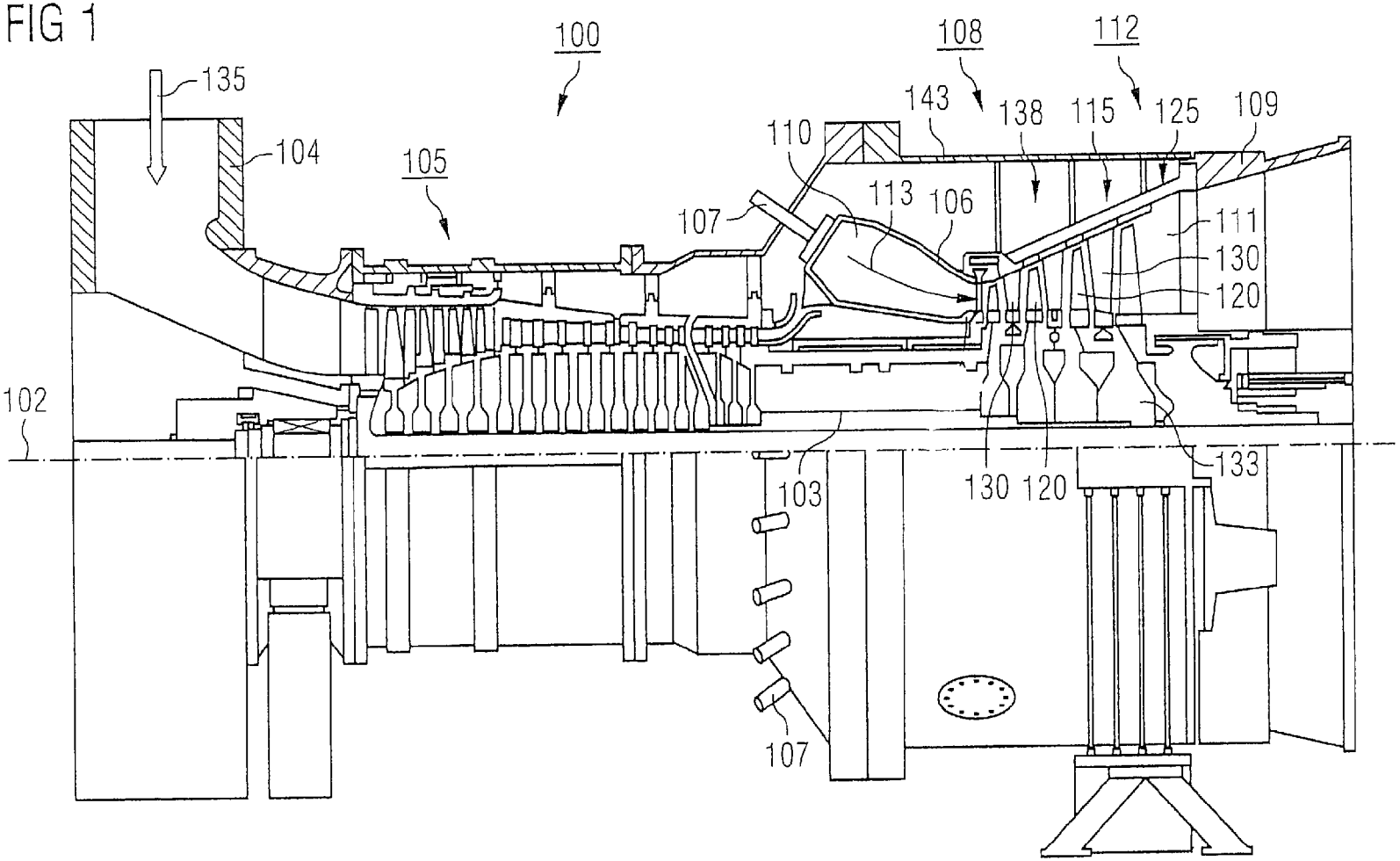
FIG. 1 shows a schematic diagram of a section along the length of a gas turbine.

FIG. 1 shows an example of a gas turbine 100 in a longitudinal part section.

The gas turbine 100 has a rotor 103 inside it supported to allow its rotation around an axis of rotation 102 with a shaft, which is also referred to as the turbine rotor.

Following each other along the rotor 103 are an induction housing 104, a compressor 105, a typically toroidal combustion chamber 110, especially an annular combustion chamber, with a number of coaxially arranged burners 107, a turbine 108 and the exhaust housing 109.

The annular combustion chamber 110 communicates with a typically annular hot gas duct 111. In this duct four turbine stages 112 connected one behind the other form the turbine 108 for example.

Each turbine stage 112 is typically formed from two rings of blades. In the hot gas duct 111, seen in the flow direction of a working medium 113, a series of guide blades 115 is followed by a series 125 composed of rotor blades 120.

The guide blades 130 are attached in this case to an inner housing 138 of a stator 143, whereas the rotor blades 120 of a series 125 are attached for example by means of a turbine disk 133 to the rotor 103.

Coupled to the rotor 103 is a generator or work machine (not shown).

During the operation of the gas turbine 100, air 135 is sucked by the compressor 105 through the induction housing 104 and compressed. The compressed air provided at the turbine-side end of the compressor 105 is directed to the burners 107 and mixed there with a fuel. The mixture is burned to form a working medium 113 in the combustion chamber 110. From there the working medium 113 flows along the hot gas duct 111 past the guide blades 130 and the rotor blades 120. At the rotor blades 120 the working medium 113 expands and imparts a pulse so that the rotor blades 120 drive the rotor 103 and this drives the working machine coupled to it.

Figure 2:
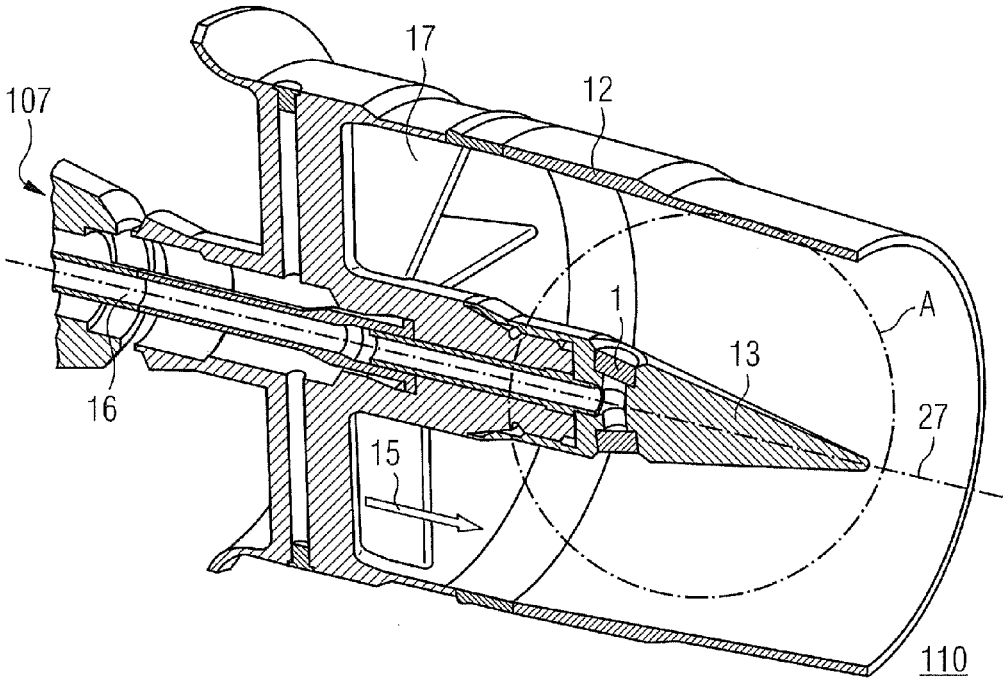
FIG. 2 shows a schematic diagram of a section through an inventive burner.

FIG. 2 shows the schematic diagram of a section through an inventive burner 107 in a part perspective view. The burner 107 can be used on one side in conjunction with the annular combustion chamber 110. Preferably the burner 107 is however used in conjunction with what is referred to as a tubular combustion chamber. In this case the gas turbine 100, instead of the annular combustion chamber 110, has a number of tubular combustion chambers arranged in a ring, of which the downstream openings open out into the annular hot gas duct 111 on the turbine inlet side. In such cases a number of burners 107, for example six or eight, are preferably arranged on the opposite end of the downstream side opening of the tubular combustion chamber, mostly in the form of a ring around a pilot burner.

The burner 107 comprises a cylindrical housing 12. In the housing 12 a lance with a fuel duct 16 is arranged along the central axis 27 of the burner 107. On the side of the lance leading into the combustion chamber 110 this has an attachment 13 coming to a point, which is arranged concentrically to the center axis 27. Arranged in the attachment 13 are inventive fuel nozzles 1 which communicate with the fuel duct 16.

Swirl blades 17 are arranged in the housing 12 of the inventive burner 107 around the lance. The swirl blades 17 are arranged along the circumference of the lance in the housing 12. A compressor air flow 15 is conveyed by the swirl blades 17 into the part of the burner 107 leading to the combustion chamber 110. A swirling motion is imparted to the air by the swirl blades 17. In the air flow arising in such cases, fuel, for example oil, is injected through the fuel nozzles. The fuel/air mixture arising as a result of this is then conveyed further in the combustion chamber 110.

Figure 3:
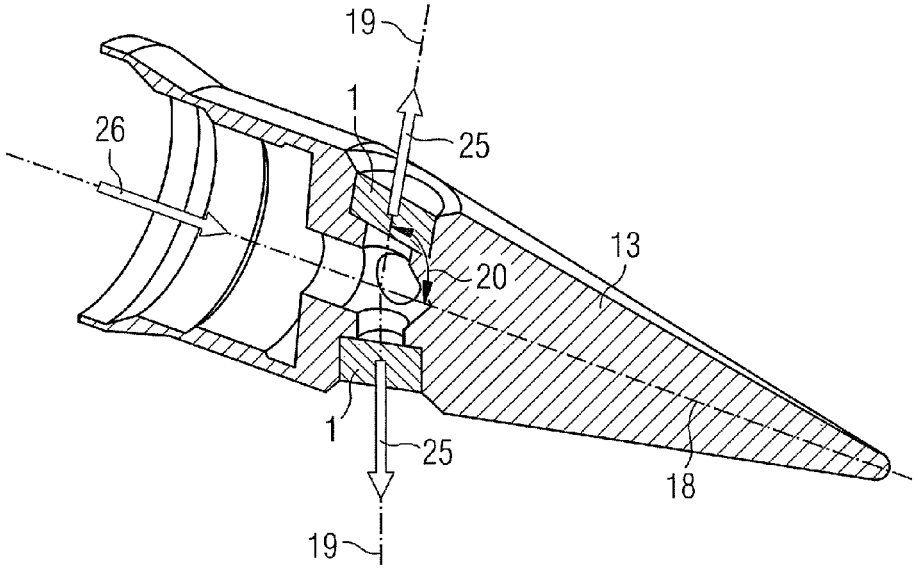
FIG. 3 shows a schematic diagram of a section through the attachment of an inventive burner.

FIG. 3 shows a schematic diagram of a section through the attachment 13 in a perspective view. The center axis of the attachment 13 is labeled with the reference sign 18. The attachment 13 is embodied conical towards the combustion chamber 110, running to a point. It comprises a number, in the present exemplary embodiment four, fuel nozzles 1. The fuel nozzles 1 are arranged on the outer circumference of the attachment 13 at appropriate depths. The center axes of the fuel nozzles 1 are labeled with the reference sign 19. The center axes 19 of the fuel nozzles 1 are at an angle 20 of between 45° and 90° to the center axis 18 of the attachment 13. The fuel passes along the fuel duct 16 in the direction of flow indicated by the reference sign 26 into the attachment 13. The fuel is then injected through the fuel nozzles 1 in the direction 25 into the air flow coming from the swirl blades 17.

Figure 4:
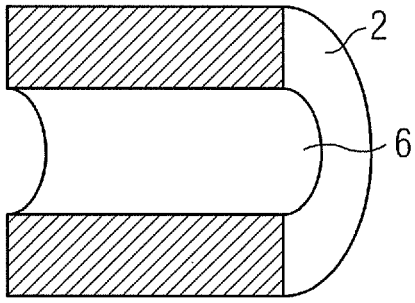
FIG. 4 shows a schematic diagram of a section through a sleeve in a perspective view.

The inventive fuel nozzle 1 comprises a sleeve 2 and a pin 3 arranged in the sleeve 2. FIG. 4 shows a schematic diagram of a section through the sleeve 2 in a perspective view. In the present exemplary embodiment the sleeve 2 takes the form of a hollow cylinder. The inner surface of the sleeve 2 is labeled with the reference sign 6.

Figure 5:
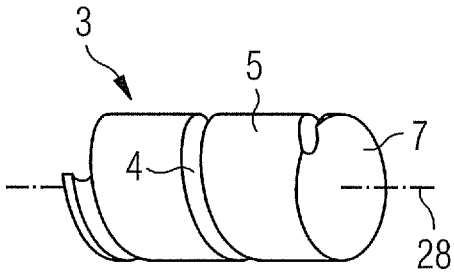
FIG. 5 shows a schematic diagram of a pin in a perspective view.

FIG. 5 shows a pin 3 in a perspective view. In the present exemplary embodiment of the pin 3 takes the form of a cylinder. The outer jacket surface of the cylinder is labeled with the reference sign 5. The cover surface of the pin 3 is labeled with the reference sign 7. A swirl duct 4 in the form of a recess runs along the outer jacket surface 5. The swirl duct 4 winds around the outer jacket surface 5 in the form of a spiral around the center axis 28 of the pin 3.

Figure 6:
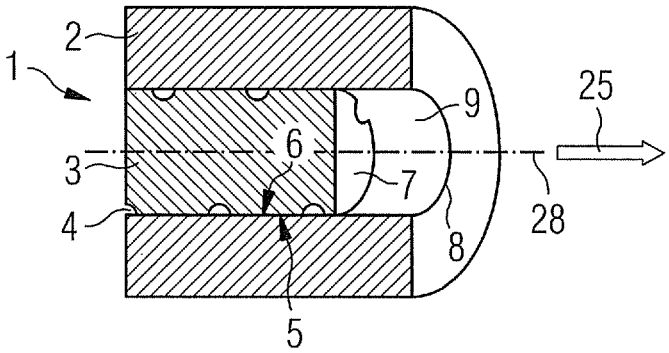
FIG. 6 shows a schematic diagram of a section through an inventive fuel nozzle in a perspective view.

FIG. 6 shows a schematic diagram of a section through the inventive fuel nozzle 1 in a perspective view. The inventive fuel nozzle 1 comprises the sleeve 2 depicted in FIG. 4 and the pin 3 depicted in FIG. 5. The pin 3 is arranged in the sleeve 2 so that the inner surface 6 of the sleeve 2 fits tightly with the outer jacket surface 5 of the pin 3. The connection can basically be a form fit or a force fit. The pin 3 can for example be soldered or driven into the sleeve 2.

The arrangement of the pin 3 in the sleeve 2 means that the swirl duct 4 is covered or restricted by the inner surface 6 of the sleeve 2 radially in relation to the center axis 28 of the pin.

The sleeve 2 features an exit opening 8 in the direction of flow 25 of the fuel leaving the fuel nozzle 1. The pin 3 is arranged in the sleeve 2 so that the cover surface of the pin 3 is set back from the exit opening 8 of the sleeve 2. In this case a swirl chamber 9 is embodied. In the swirl chamber 9 the fuel, in the present example the oil, is mixed with air. The setting back also allows a film instead of a jet atomization. It is also possible for the cover surface 7 to be flush with the exit opening 8.

Figure 7:
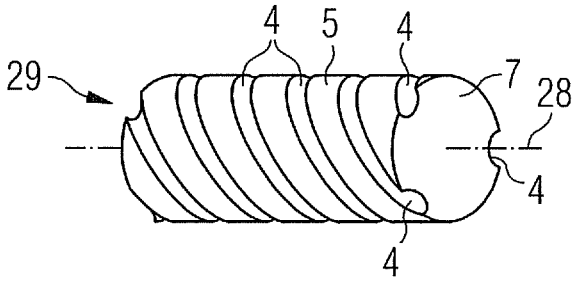
FIG. 7 shows a schematic diagram of an alternate embodiment of a pin in a perspective view.

An alternate embodiment variant of the pin 3 is shown in FIG. 7. FIG. 7 shows a schematic diagram of a pin 29 in a perspective view. By contrast with the pin 3 depicted in FIG. 5, the pin 7 features three swirl ducts 4 arranged in a spiral form around the center axis 28 of the pin 29 along the outer jacket surface 5. The swirl ducts 4 are arranged offset to one another in the circumferential direction. In this case the adjacent swirl ducts 4 in each case can be arranged for example along the circumference of the pin 29 offset in relation to each other by an angle of 120°. As an alternative to the variant depicted in FIG. 7, the pin 3, 29 can also comprise any other given number of swirl ducts 4.

A second exemplary embodiment of the present invention is explained in greater detail with reference to FIGS. 8 through 10. Elements which correspond to elements of the first exemplary embodiment are provided with the same reference signs and are not described again in detail.

Figure 8:
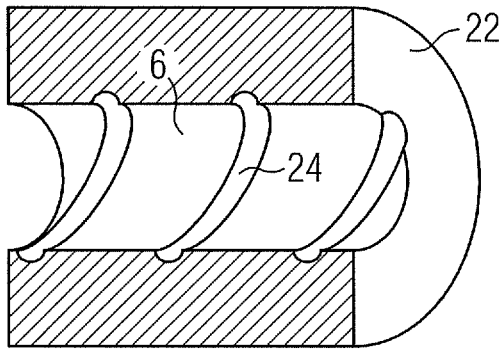
FIG. 8 shows a schematic diagram of the section through an alternately embodied sleeve in a perspective view.

FIG. 8 shows a schematic diagram of a section through a sleeve 22 in a perspective view. Compared to the sleeve depicted in FIG. 4, the sleeve 22 is characterized by a swirl duct 24 being arranged along its inner surface 6. The swirl duct 24 winds in the shape of a spiral in relation to the center axis of the sleeve 21 along its inner surface 6.

Figure 9:
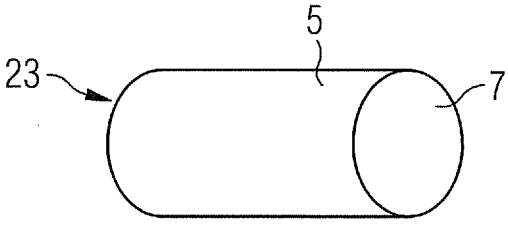
FIG. 9 shows a schematic diagram of a pin in a perspective view.

FIG. 9 shows a schematic diagram of a pin 23 in a perspective view. The pin 23 used in the present exemplary embodiment takes the form of a cylinder, and by contrast with the pin 3 depicted in FIG. 5, has no swirl duct. The pin 23 comprises an outer jacket surface 5 and a cover surface 7.

Figure 10:
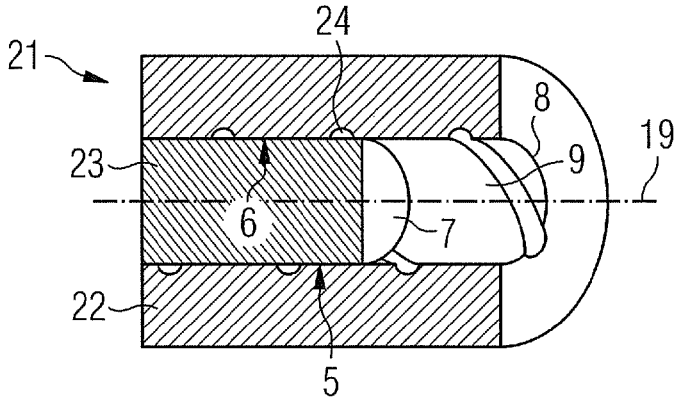
FIG. 10 shows a schematic diagram of a section through an alternately embodied fuel nozzle in a perspective view.

FIG. 10 shows a schematic diagram of a section through an inventive fuel nozzle 21 in a perspective view. The fuel nozzle 21 comprises the sleeve 22 depicted in FIG. 8 and the pin 23 depicted in FIG. 9. The pin 23 is arranged in this case in the sleeve 22 such that the outer jacket surface 5 of the pin 23 makes a tight-fitting connection the inner surface 6 of the sleeve 22. The connection can basically be a form-fit or a force-fit connection. The swirl duct 24 is radially covered or restricted towards the center axis 19 by the arrangement of the pin 23 in the sleeve 22.

The sleeve 22 used can of course also comprise a number of swirl ducts 24 arranged offset in relation to each other. In such cases, in the case of three swirl ducts 24 the respective adjacent swirl ducts 4 can be arranged for example along the circumference of the pin 23 offset by an angle of 120° in relation to one another.

The pin 23 is also arranged in the sleeve 22 so that the cover surface 7 of the pin 23 is set back in relation to the exit opening 8 of the sleeve 22. A swirl chamber 9 is thus produced between the cover surface 7 of the pin 23 and the exit opening 8, in which fuel is mixed with air.

A third exemplary embodiment will be explained in greater detail below with reference to FIG. 11. Elements which correspond to elements of the previous exemplary embodiments are provided with the same reference signs and will not be described in detail again.

Figure 11:
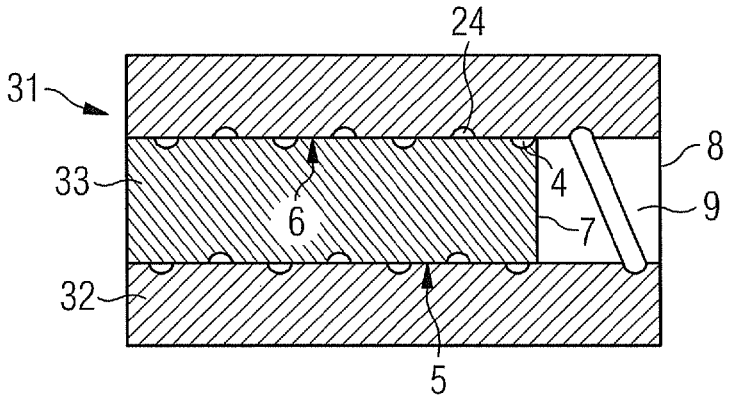
FIG. 11 shows a schematic diagram of a section through a further inventive fuel nozzle.

FIG. 11 shows an inventive fuel nozzle 31 which involves a combination of the sleeve 22 of the second exemplary embodiment and the pin 3, 29 of the first exemplary embodiment. The fuel nozzle 31 comprises a sleeve 32 which features a swirl duct along its inner surface 6. The swirl duct 24 has the same characteristics as the swirl duct 24 described in conjunction with FIGS. 8 and 10.

A pin 33 is arranged in the sleeve 32. The pin 33 has the same features as the pin 3 described in conjunction with FIG. 5 or as the pin 29 described in conjunction with FIG. 7. The pin 33 includes a swirl duct 4. The pin 33 is arranged in the sleeve 32 so that the swirl duct 4 is covered by the inner surface 6 of the pin 32 and so that the swirl duct 24 is covered by the outer jacket surface 5 of the pin 33. This produces two swirl ducts in the fuel nozzle 31. A swirl duct 9 is located inside the sleeve 32 between the cover surface 7 of the pin 33 and the exit opening 8 of the sleeve 32.

Figure 12:
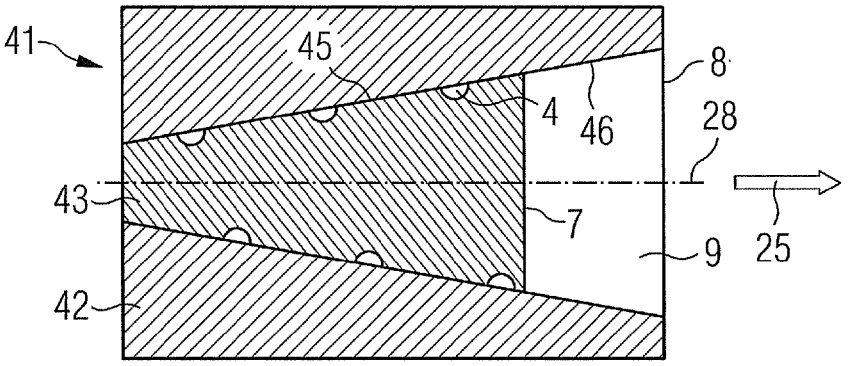
FIG. 12 shows a schematic diagram of a section through a further inventive fuel nozzle.

A fourth exemplary embodiment will be explained in greater detail below with reference to FIG. 12. Elements which correspond to elements of the previous exemplary embodiments are provided with the same reference signs and will not be described in detail again. FIG. 12 shows a schematic diagram of a section through an inventive fuel nozzle 41. The fuel nozzle 41 comprises a sleeve 42 and a pin 43. The pin 43 is arranged within the sleeve 42. By contrast with the previous exemplary embodiments, the outer jacket surface 45 of the pin 43 and the inner surface 46 of the sleeve 42 take the form of the outer jacket surface of a cone base. This means that the radius of the pin 43 enlarges conically in relation to the center axis 28 towards the direction of flow of the fuel. Likewise the inner diameter of the sleeve 42 enlarges conically towards the direction of flow 25 of the fuel.

The pin 43 has at least one swirl duct 4 running in the form of a spiral along its outer jacket surface 45. The cover surface 7 of the pin 43 is arranged inside the sleeve 42 set back in relation to the exit opening 8. A swirl chamber 9 is formed in this way in the sleeve 42 in which the fuel will be mixed with air. As an alternative to the embodiment variants depicted in FIG. 12, just the sleeve 42 or both the sleeve 42 and also the pin 43 can include at least one swirl duct.

Basically, within the framework of all exemplary embodiments and embodiment variants of the present invention, a change, for example of the diameter, the eccentricity, the conical form or also a multi-stage injection through a number of swirl ducts, enables the exit of the fuel to be controlled. The fuel involved can especially be oil. In all the exemplary embodiments the pin can be soldered or driven into the sleeve for example. The respective swirl ducts can be manufactured using different manufacturing methods. They can for example be inserted into the respective surface of the pin and/or of the nozzle by milling, turning, punching, eroding, sintering or profile extruding. Furthermore the respective surface of the pin and/or of the nozzle can be created by casting.

In principle it is possible, for all embodiments shown, for the cover surface 7 to be in one plane with the exit opening 8. To form a swirl chamber it is then simply necessary for the fuel nozzle 1, 21, 31, 41 to be set back in relation to the surface of the attachment 13.

In addition it is also possible for the embodiments of the fuel nozzle 1, 21, 31 depicted in FIGS. 6, 10 and 11 for the surface of the exit opening 8 to be smaller than the cover surface 7 of the pin 3, 23, 33. In this case the pin 3, 23, 33 will be inserted from the upstream side of the sleeve 2, 22, 32.

The invention claimed is:

1. A fuel nozzle, comprising:
a pin including an outer jacket surface; and
a sleeve including an inner surface,
wherein the pin is arranged in the sleeve,
wherein the outer jacket surface of the pin and/or the inner surface of the sleeve includes a swirl duct, and
wherein the fuel nozzle is embodied as an oil nozzle.

2. The fuel nozzle as claimed in claim 1, wherein the swirl duct is embodied in a form of a spiral.

3. The fuel nozzle as claimed in claim 1,
wherein the outer jacket surface of the pin and/or the inner surface of the sleeve is embodied in a cylindrical, conical or eccentric shape.

4. The fuel nozzle as claimed in claim 1, further comprising at least two swirl ducts.

5. The fuel nozzle as claimed in claim 4, wherein the at least two swirl ducts are arranged offset to one another in a circumferential direction.

6. The fuel nozzle as claimed in claim 5, wherein adjacent swirl ducts are arranged along a circumference of the pin offset in relation to one another by an angle of 120°.

7. The fuel nozzle as claimed in claim 1,
wherein the pin includes a cover surface,
wherein the sleeve includes an exit opening, and
wherein the pin is disposed in the sleeve so that the cover surface is set back in relation to the exit opening to an inside of the sleeve.

8. The fuel nozzle as claimed in claim 7,
wherein a surface of the exit opening is smaller than the cover surface of the pin.

9. A burner, comprising:
a fuel nozzle, comprising:
a pin including an outer jacket surface, and
a sleeve including an inner surface,
a cylindrical housing including a lance featuring a fuel duct arranged centrally therein, which is supported on the housing via a plurality of swirl blades in a radial arrangement and on which an attachment is arranged on a side leading to a combustion chamber, and
wherein the fuel nozzle is arranged in the attachment,
wherein the pin is arranged in the sleeve,
wherein the outer jacket surface of the pin and/or the inner surface of the sleeve includes a swirl duct.

10. The burner as claimed in claim 9, wherein the fuel nozzle is arranged in the attachment downstream from the plurality of swirl blades and is flow connected to a fuel channel.

11. The burner as claimed in claim 9,
wherein the attachment includes a first central axis,
wherein the fuel nozzle includes a second central axis, and
wherein the fuel nozzle is arranged in the attachment such that the second central axis is at an angle of between 45° and 90° to the first central axis.

12. The burner as claimed claim 9,
wherein the sleeve includes an exit opening, and
wherein the exit opening is set back in relation to the outer jacket surface of the attachment.

* * * * *